US008488820B2

(12) United States Patent
Pedersen

(10) Patent No.: US 8,488,820 B2
(45) Date of Patent: Jul. 16, 2013

(54) SPATIAL AUDIO PROCESSING METHOD, PROGRAM PRODUCT, ELECTRONIC DEVICE AND SYSTEM

(75) Inventor: Jens Erik Pedersen, Kovshojsvej (DK)

(73) Assignee: Palm, Inc., Sunnyvale, CA (US)

( * ) Notice: Subject to any disclaimer, the term of this patent is extended or adjusted under 35 U.S.C. 154(b) by 1140 days.

(21) Appl. No.: 11/747,072

(22) Filed: May 10, 2007

(65) Prior Publication Data

US 2007/0291967 A1 Dec. 20, 2007

Related U.S. Application Data

(63) Continuation of application No. PCT/EP2005/052997, filed on Jun. 27, 2005.

(30) Foreign Application Priority Data

Nov. 10, 2004 (EP) ..... 04026708

(51) Int. Cl.
*H04R 5/02* (2006.01)
*H04R 5/00* (2006.01)

(52) U.S. Cl.
USPC ..... 381/310; 381/17; 381/309

(58) Field of Classification Search
USPC ..... 381/309, 110, 310, 56, 17, 119
See application file for complete search history.

(56) References Cited

U.S. PATENT DOCUMENTS

| | | | | |
|---|---|---|---|---|
| 6,011,851 | A * | 1/2000 | Connor et al. | 381/17 |
| 2004/0136538 | A1 | 7/2004 | Cohen et al. | |
| 2007/0053527 | A1 * | 3/2007 | Barbieri et al. | 381/104 |

* cited by examiner

*Primary Examiner* — Vivian Chin
*Assistant Examiner* — Douglas Suthers

(57) ABSTRACT

A method comprises the steps of: receiving a first audio signal ($S_1$); generating a digital representation ($S_1$") of the first audio signal ($S_1$) by applying a head-related transfer function (HRTF) in a first sound reproduction position ($r_1$); and changing the first sound reproduction position ($r_1$) to a second sound reproduction position ($r_3$) in response to receiving a second audio signal $S_2$) or a precursor signal for a second audio signal ($S_2$).

12 Claims, 5 Drawing Sheets

Replacement Sheet 1

SPATIAL AUDIO PROCESSING METHOD, PROGRAM PRODUCT, ELECTRONIC DEVICE AND SYSTEM

RELATED APPLICATIONS

The present application is a continuation of International Patent Application Number PCT/EP2005/052997, designating the United States of America, filed Jun. 27, 2005, entitled "A SPATIAL AUDIO PROCESSING METHOD, A PROGRAM PRODUCT, AN ELECTRONIC DEVICE AND A SYSTEM", which claims foreign priority to European Patent Application Number 04026708.0, filed Nov. 10, 2004, entitled "A SPATIAL AUDIO PROCESSING METHOD, A PROGRAM PRODUCT, AN ELECTRONIC DEVICE AND A SYSTEM". These applications are incorporated herein by reference in their entirety and for all purposes.

BACKGROUND OF THE INVENTION

Progress in computational sciences and acoustic field theory has opened interesting possibilities in sound technology. As a practical example of new technologies, a tool relatively new on the market is a software product that can be used to create an impression of position of a source of an audio signal when a user listens a representation of the audio signal through at least two channel headphones.

In practice, when such a tool is run in a processor in a form of a software product, the audio signal will be passed through a head-related transfer function (HRTF) in order to generate, for a user wearing at least two channel (e.g. stereo) headphones, a psychoacoustic impression of the audio signal arriving from a predefined position.

The mechanism how the psychoacoustic impression is created can be illustrated by way of an example. As we know from the daily life, a person can observe the position r (bold denotes here a vector which may be expressed with r, $\Phi$, and $\theta$ in spherical coordinates) of a sound source with a rather good precision. So if sound is emitted by a sound source located close to the left ear ($r=30$ cm, $\Phi=3\pi/2$, $\theta=0$), it is first received by the left ear and only a fraction of a second later by the right ear. Now if an audio signal is reproduced through headphones first to the left ear and the fraction of a second later by the right ear through headphones, which can be performed by filtering the signal through a respective head-related transfer function, the listener gets an impression of the sound source being located close to the left ear.

A more thorough discussion of different properties of a HRTF and how it can be obtained can be found e.g. in published US patent application 2004/0136538 A1, which is incorporated by reference in its entirety herein.

Additional features and advantages of the present invention are described in, and will be apparent from, the following Detailed Description of the Invention and the figures.

SUMMARY OF THE INVENTION

The human capability to receive information by listening is rather limited. Especially the capability to follow one sound source can be highly impaired when another sound source is present. Accordingly, the present disclosure brings fourth a method, a program product, an electronic device, and a system with which the perception of an audio signal from a first sound source may be improved when an audio signal from another sound source is received simultaneously with the signal of the first source.

Under an exemplary embodiment, if the first position in which a head-related transfer function is applied to a first audio signal is changed to a second sound reproduction position in response to receiving a second audio signal or a precursor signal for a second audio signal, the user may be in a better position to better distinguish between the first and the second signal.

Furthermore, the transferring of the first audio signal from the first sound reproduction position to the second sound reproduction position can be automated.

By performing the change in response to receiving a precursor signal, the transferring can be made prior to beginning to reproduce the second audio signal, thus improving user comfort since the position of the first audio signal can be transferred before beginning to reproduce the second audio signal.

If the second audio signal is a paging signal or a speech signal, it may be easier for the user to concentrate on the second audio signal while still being able to listen to the first audio signal. For example, if a telephone call will be reproduced as the second audio signal, the user may continue listening to the first audio signal such as radio or music from MP3 or CD while still being able to carry a telephone conversation.

Furthermore, bringing a second sound reproduction position back to a first sound reproduction position can be made in response to not receiving the second audio signal any more. For example, after hanging up a telephone call the first sound reproduction position can be used automatically.

If the precursor signal is a message for establishing a telephone call or a message triggered by a telephone call that is going to be established, the user comfort when receiving the telephone call may be improved. The beginning of a telephone call is usually of outermost importance, since the caller and/or called party normally identify themselves.

The user might thus found it disturbing if the first audio signal were transferred only when a call has been established. In this manner he or she may have some time to prepare him- or herself for a beginning telephone call.

If the second sound reproduction position is further away than the first sound reproduction position, the user's ability to differentiate between the signals may be improved.

Furthermore, if a head-related transfer function, preferably the same head-related transfer function as for the first audio signal, is applied to the second audio signal in a third sound reproduction position, the third sound reproduction position being closer to the head of the user than the second sound reproduction position, the user's concentration on the second audio signal may not be impaired that much by disturbance caused by the first audio signal.

BRIEF DESCRIPTION OF THE FIGURES

The various objects, advantages and novel features of the present disclosure will be more readily apprehended from the following Detailed Description when read in conjunction with the enclosed drawings, in which.

DETAILED DESCRIPTION OF THE INVENTION

In the present disclosure, same reference symbols refer to similar features throughout the drawings.

An exemplary electronic device is disclosed that can be used by a user wearing at least two-channel (e.g. stereo) headphones. The electronic device is adapted to pass an at least two-channel signal (e.g. a stereophonic signal) to headphones, preferably over a wireless link.

Figure 1A:
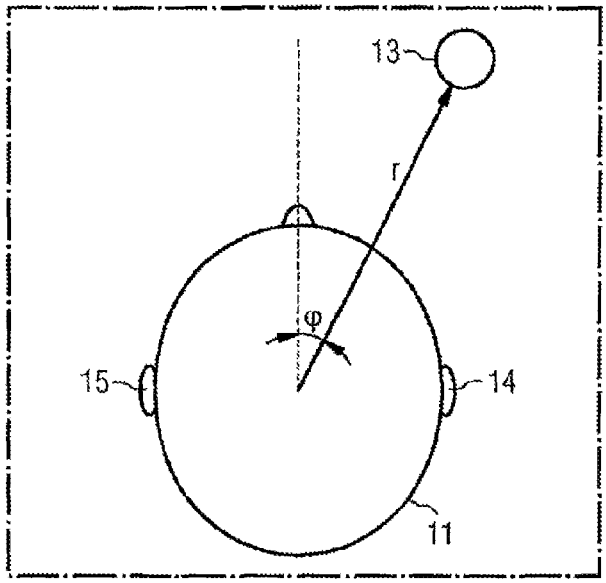
FIG. 1A illustrates a location of a sound source in head coordinates under are exemplary embodiment.

FIG. 1A shows an example of head coordinates in one plane. A sound source 13 is located at point r (at distance r and at angle Φ) as seen from the middle of the head 11 of the person. The acoustic conditions of the room are denoted with e, mostly resulting from echo and background noise.

Figure 1B:
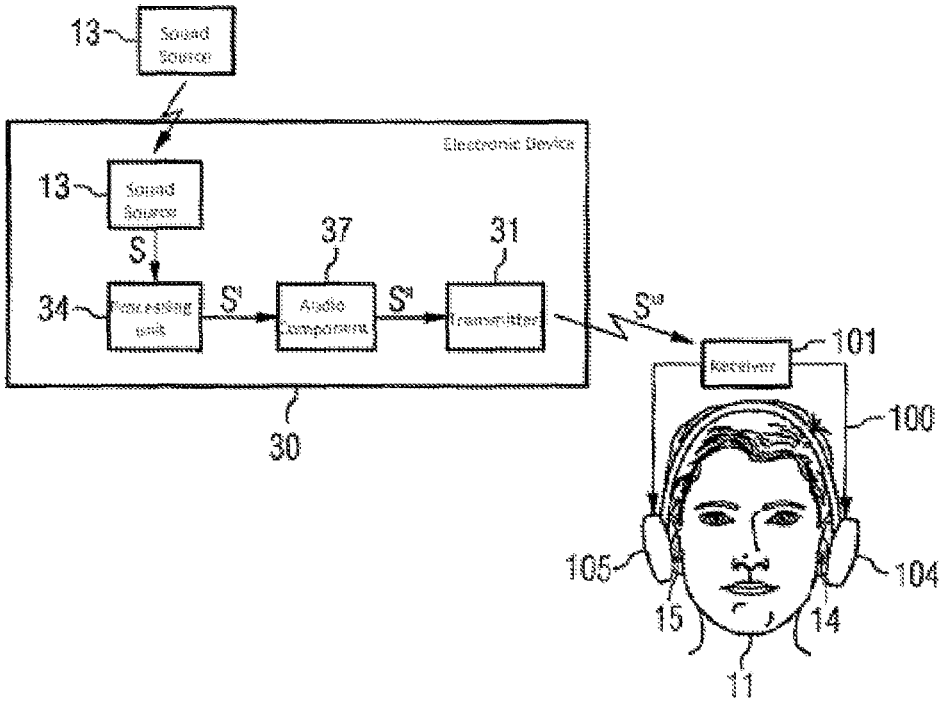
FIG. 1B illustrates a user wearing headphones under the exemplary embodiment.

FIG. 1B illustrates the head 11 of a user of an electronic device 30 wearing at least two-channel (e.g. stereo) headphones 100 that are adapted to receive a representation S''' of an audio signal S from the electronic device 30 via its receiving means 101. The headphones 100 comprise at least two acoustic transducers (such as loudspeakers) 104 and 105, one for the right ear 14 and one for the left 15. The headphones 100 are adapted to reproduce sound from received representation S''' for at least two channels (i.e. at least left and right). The electronic device 30 is described in more detail below with reference to FIG. 3.

By suitably selecting a head-related transfer function (HRTF) which causes suitable phase differences and attenuation, possibly in a frequency-dependent manner, and applying it to an audio signal S in processing unit 34 for at least two channels (at least left and right), a digital representation S' may be generated which is then handled in the electronic device 30 and finally passed to headphones 100 as representation S'. When this representation is listened by a user, it makes an impression that the sound source 13 is located at a definite position (sound reproduction position r). The sound reproduction position r can at easiest be expressed as a point in polar or spherical coordinates but it can be expressed in any other coordinate system too.

The location of the sound source 13 as in FIG. 1A may be chosen in the electronic device 30, e.g. in its processing unit 34, by selecting a sound reproduction position r that is used by the HRTF to modify its filtering characteristics. As an alternative, separate HRTFs can be used (one for each sound reproduction position r), then the HRTF to be used is changed when the sound reproduction position r changes.

On one hand, an HRTF can be used in order to carry out the present invention if a high-quality 3D impression is desired. Would this approach be adapted, the HRTF could be stored in the electronic device 30. Since one electronic device may have several users (e.g. members of a family), the electronic device 30 may therefore comprise a larger number of HRTFs, one for each user. The selection of the HRTF that is to be used can be selected e.g. based on a code entered to the electronic device 30 by the user. Alternatively, the selection can be based on an identifier identifying of the headset 100, if users prefer to use their personal headsets.

On the other hand, a simpler method for defining the HRTF will do, especially if 2D reproduction of the sound image is enough. The reproduction may be carried out using software modules and the like.

A general HRTF can also be used for all users. An especially suitable HRTF of that kind is one that has been recorded using a head and torso simulator. The HRTF is then preferably stored for a large selection of angles around the head. In order to obtain a resolution of two degrees, 180 HRTF positions should be stored. In order to obtain a resolution of 5 degrees, 72 HRTF positions should be stored, for 2D reproduction of the sound source. To control the distance further HRTF positions are preferably needed.

With term "2D reproduction of the sound source", position of the sound source 13 would approximately be located in one level, preferably in the ear level of the user. With "3D reproduction of the sound source", the sound source 13 can be located also below or above this level.

Figure 2:
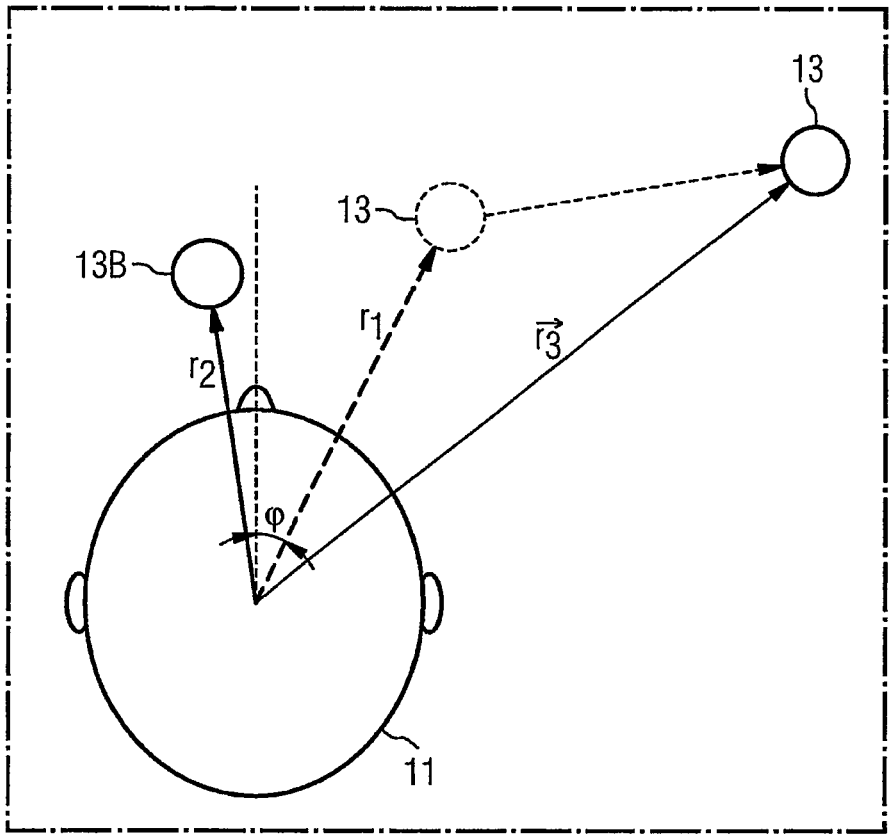
FIG. 2 illustrates an exemplary changing of a sound reproduction position.

FIG. 2 illustrates how the sound reproduction position (i.e. the position from where the user listening to a reproduction of representation $S_1'''$ observes the sound source 13 being located) of an audio signal $S_1$ can be changed from the first sound reproduction position $r_1$ to a second sound reproduction position $r_3$ according to one aspect of the invention.

An audio signal $S_1$ from a sound source 13 is first received at or reproduced by the electronic device 30. The audio signal $S_1$ is then handled by the electronic device 30 by applying a HRTF with a first sound reproduction position $r_1$. The thus handled signal, after being converted to an analog signal and after amplifying, makes an impression of the sound source 13 being located in position $r_1$, when listened through at least two-channel headphones 100.

In response to receiving a second audio signal $S_2$ from a second sound source 13B, or a precursor signal for a second audio signal $S_2$, the first sound reproduction position $r_1$ of the HRTF is replaced with a second sound reproduction position $r_3$ so that the representation $S_1'''$ of the audio signal $S_1$ gives, when listened through at least two-channel headphones 100, an impression of the sound source 13 being located in position $r_3$.

Furthermore, the HRTF can be applied to the second audio signal $S_2$ with a third sound reproduction position $r_2$. Then the representation $S_2'''$ of the audio signal $S_2$ gives, when listened through at least two-channel headphones, an impression of the second sound source 13B being located in position $r_2$.

The transition from position $r_1$ to position $r_3$ may be performed smoothly i.e. in small steps. This makes an impression of the sound source 13 being moved.

Figure 3:
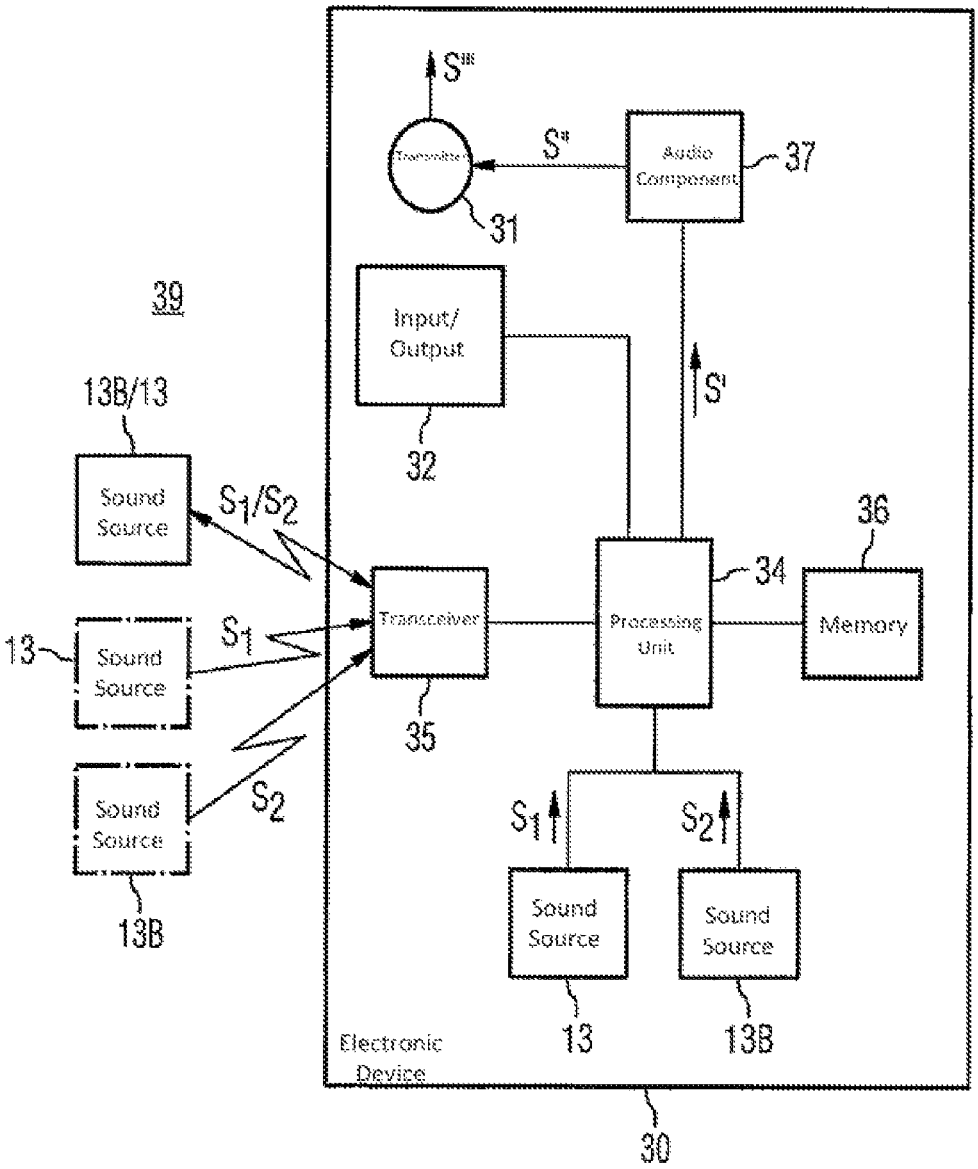
FIG. 3 illustrates functional blocks of an electronic device under the exemplary embodiment.

FIG. 3 shows some functional blocks of electronic device 30.

The electronic device 30 preferably comprises means 35 for receiving and transmitting data to/from a communications network 39, especially a radio receiver and a radio transmitter. The data transmission between the electronic device 30 and the communications network 39 may take place over a wireless interface or an electrical interface. An example of the former is the air interface of a cellular communications network, especially a GSM network, and of the latter the traditional interface between a telephone device and a Public Switched Telephony Network PSTN.

The electronic device 30 further comprises input/output means 32 for operating the electronic device 30. Input/output means 32 may comprise a keypad and/or joystick that is preferably suitable for dialling a number or selecting a destination address or name from a phonebook stored in the memory 36, the keypad preferably further comprising a dial toggle and answer button. The input/output means 32 may further comprise a display.

An electronic device 30 according to the exemplary embodiment comprises means 31 for passing a representation S''' of an audio signal S to headphones 100. The means 31 may comprise a wireless transmitter.

The electronic device 30 further comprises a processing unit 34, such as a microprocessor, and memory 36. The processing unit 34 is adapted to read software as executable code and then to execute it. The software is usually stored in the memory 36. The HRTF is also stored in the memory 36, from which =the processing unit 34 can access it.

The electronic device 30 may further comprise one or more sound sources 13, 13B. Sound sources 13, 13B can be FM or digital radio receivers, or music players (in particular MP3 or CD players). Sound sources 13, 13B can also be located externally to the electronic device 30, meaning that a corresponding audio signal is received through means 35 for receiving data from a communications network 39, especially through a radio receiver, through a generic receiver (such as Bluetooth), or through a dedicated receiver. Audio signal received from an external sound source 13, 13B is then handled in the manner similar to an audio signal received from an internal sound source. Therefore, the audio signal S may be any audio signal generated in the electronic device 30, reproduced from a music file such as an MP3 file), received from the communications network 39 or from FM or digital radio. The representation S''' can be passed to the headphones 100 by using a wireless link, such as Bluetooth, or over a cable.

Between the processing unit 34 and the means 31 for passing a representation S''' of an audio signal S to headphones 100 there may be further components 37. They are to some extent necessary to change a digital representation S' from the processing unit 34 to a signal S'' suitable for the means 31 for passing a representation S''' of an audio signal S to headphones 100. These components 37 may comprise a digital-to-analog converter, an amplifier, and filters. A more detailed description of them is nevertheless omitted here for the sake of simplicity.

Figure 4:
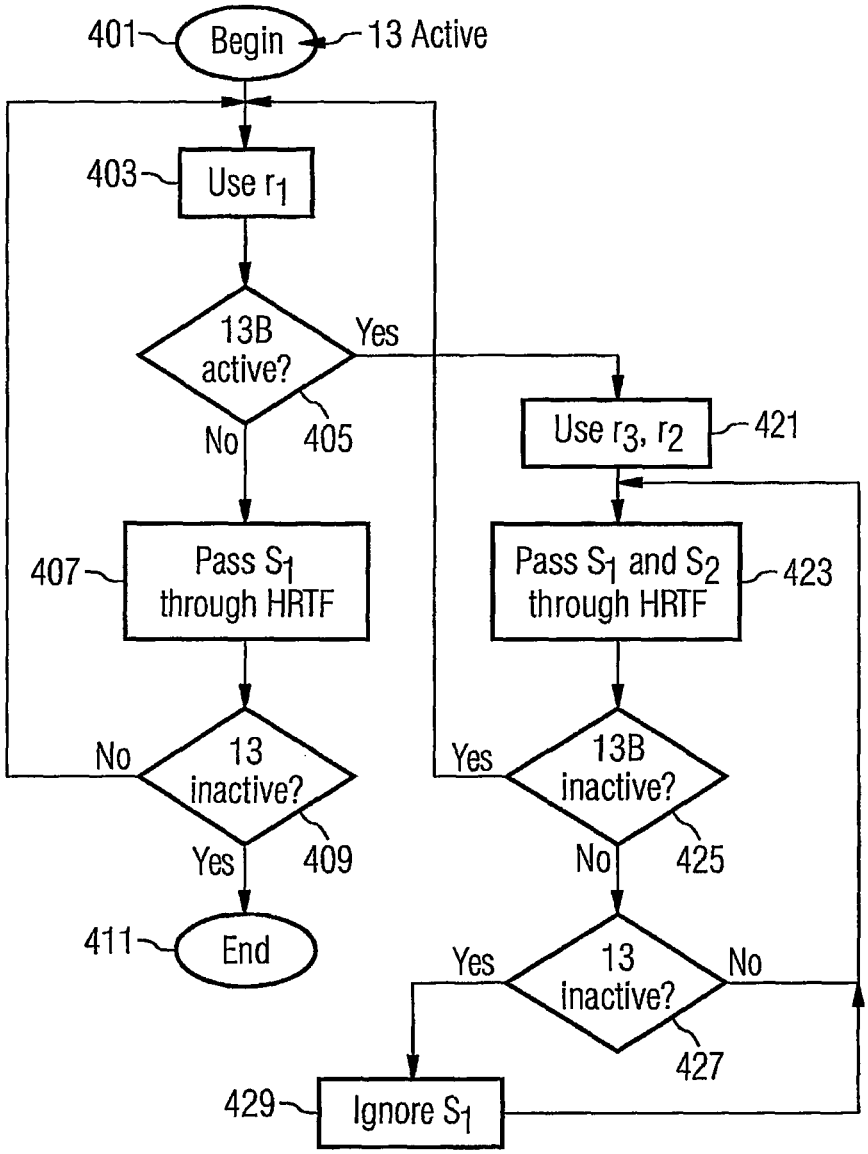
FIG. 4 is a flow chart illustrating signal processing in the embodiment of FIG. 2.
Figure 5A:
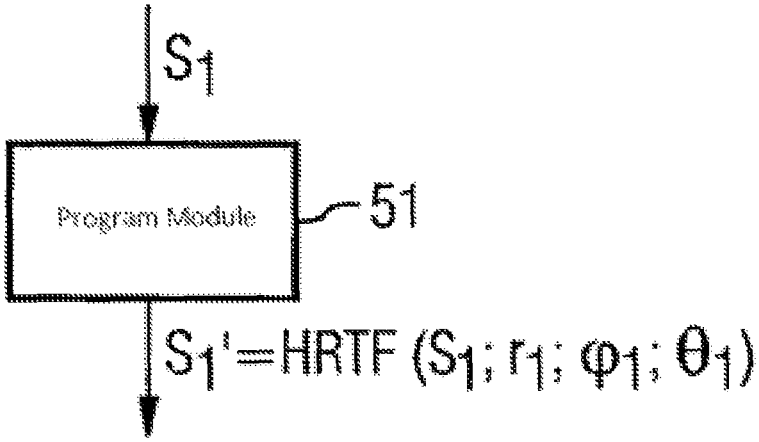
FIG. 5A illustrates signal processing in the case of one signal source.
Figure 5B:
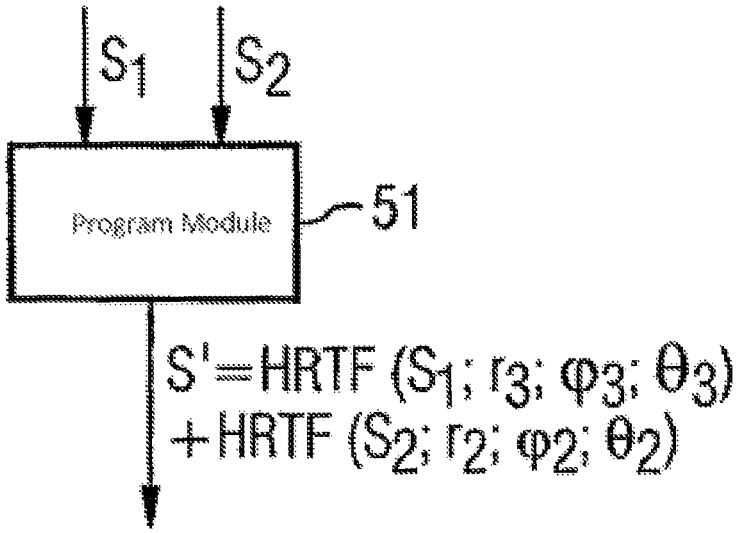
FIG. 5B illustrates signal processing in the case of two signal sources.

FIG. 4 is a flow chart illustrating signal processing in the example of FIG. 2. The flow chart is explained together with FIGS. 5A and 5B which illustrate signal processing in the case of one and two signal sources, respectively.

The processing unit 34 executes an audio program module 51 stored in memory 36. Originally, the audio program module 51 can be installed in the electronic device 30 by using input/output means 32, an exchangeable memory means such as a memory stick, or downloaded from a communications network 39 or from a remote device. Prior to installation, the audio program module 51 is preferably in a form of program product that can be sold to customers.

The audio program module 51 comprises the HRTF which may be user-definable so that every user may have his or her own HRTF in order to improve the acoustic quality. However, for entry level purposes, a simple HRTF will do.

The audio program module 51 is started in step 401 as soon as sound source 13 producing audio signal $S_1$ is activated. Normally, the audio signal $S_1$ is handled by the audio program module 51 by using a first sound reproduction position $r_1$ that is selected in step 403. If the second sound source 13B is inactive, i.e. there is no other active sound 13B present (which is detected in step 405), the audio signal $S_1$ is in step 407 passed through the HRTF. The audio program module 51 generates a digital representation $S_1'$ by applying the HRTF with the first sound reproduction position $r_1$ to the audio signal $S_1$. This is repeated until the sound source 13 becomes inactive in step 409.

The audio signal $S_1$, may comprise of signal for more than one channel. For example, if the audio signal $S_1$ is a stereo signal (such as from an MP3 player as signal source 13), it would already comprise signal for two channels (left and right). The HRTF can be applied with the first sound reproduction position $r_1$ to the left and right channel separately. Then the resulting altogether four digital representations can be combined in order to have only one signal for both left and right channels.

More than two sound sources can be supported. For example, a stereo MP3 signal (as sound source 13) comprises already two sound sources, both audio signals from which need to be placed in different positions. The other sound source 13B could then preferably be an audio signal from an incoming call or an audio signal (such as a ringing tone) generated for paging the user.

If in step 405 it is detected that a second sound source 13B is active, in step 421 sound reproduction position $r_3$ is selected for the sound source 13 and sound reproduction position $r_2$ is selected for the other sound source 13B. Then in step 423 a digital representation S' is generated by applying the HRTF with the second sound reproduction position $r_3$ to the audio signal $S_1$, and optionally by applying the HRTF with the third sound reproduction position $r_2$ to the second audio signal $S_2$. This is repeated until either one of the sound sources 13, 13B becomes inactive or the audio program module 51 stops receiving a corresponding audio signal $S_1$, $S_2$ (tested in steps 427 and 425, respectively).

If sound source 13 becomes inactive or the audio signal $S_1$ is not received at the audio program module 51, in step 429 the audio signal $S_1$, possibly received by the audio program module 51, is ignore in step 429.

If sound source 13B becomes inactive or the audio signal $S_2$ is not received at the audio program module 51, execution control is returned by step 425 to step 403.

The audio program module 51 may thus, in step 423, generate, when executed in the processing unit 34, a digital representation signal $S_2'$ of the second audio signal $S_2$ for at least two sound channels (LEFT, RIGHT) by applying the HRTF in a third sound reproduction position $r_2$. The digital representation signal $S_2'$ is adapted to make an impression, after being digital-to-analog converted, amplifying and filtering, when being listened through at least two channel headphones 100, of the second audio signal $S_2$ arriving from the third sound reproduction position $r_2$.

The HRTF is applied in the processing unit 34 preferably separately for both audio signals $S_1$ and $S_2$, both with different sound reproduction positions (i.e. $r_3$ and $r_2$). The digital representations $S_1'$ and $S_2'$ can then be combined to a combined digital representation $S'=S_1'-+-S_2'$. Since both digital representations $S_1'$ and $S_2'$ comprise information for at least two channels (left and right), it may be advantageous also to perform channel synchronization when combining the digital representations $S_1'$ and $S_2'$.

In other words, if one sound source 13 is adapted to give out a stereo signal as the audio signal $S_1$, each channel of the audio signal $S_1$ is passed separately through the HRTF, with sound reproduction position $r_3$ (or $r_3$). The resulting four signals are then summed (two by two) in order to generate the digital representation $S_1'$. The same applies if the other sound source 13B is adapted to give out a stereo signal as the audio signal $S_2$, but now with $r_2$ as the sound reproduction position ($r_2$).

If the third sound reproduction position $r_2$ is closer to the middle of the head of the user than the second sound reproduction position $r_3$, i.e. $|r_2|<|r_3|$, the user may be in a better position to follow the second sound source 13B, i.e. the disturbance caused by sound source 13 may be reduced.

The second audio signal $S_2$ may be a paging signal or a speech signal received from the communication network 39.

A precursor signal for a second audio signal $S_2$ may be in the form of a message from the communication network 39 for establishing a telephone call or a message triggered by a telephone call that is going to be established.

The user may preferably define, using the input means 32, the first sound reproduction position $r_1$ and/or the second sound reproduction position $r_3$ for the first audio signal $S_1$. By using output means 32, the said sound reproduction positions can be visualized, e.g. on the screen of the electronic device. This should facilitate in defining the directions.

Although the invention was described above with reference to the examples shown in the appended drawings, it is obvious that the invention is not limited to these but may be modified by those skilled in the art without difference from the scope and the spirit of the invention.

While the invention has been described with reference to one or more exemplary embodiments, it will be understood by those skilled in the art that various changes may be made and equivalents may be substituted for elements thereof without departing from the scope of the invention. For example, in addition to the sound reproduction positions $r_1$, $r_2$, $r_3$, a parameter, sometimes referred to as "room parameter" can also be defined and fed to the audio program module 51. The room parameter describes the effect of the "surrounding room", e.g. possible echo reflecting from the walls of an artificial room. The room parameter and consequently the effect of the surrounding room may be changed together when changing the sound reproduction position $r_1$ to $r_3$. The user can thus hear e.g. a change from a smaller room to a larger room, or the opposite. For example, if $|r_3|$ is larger than $|r_1|$ so that $r_1$ would be close to or beyond the wall of the "surrounding room", it may be appropriate to increase the room size. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

The invention claimed is:

1. A method comprising the steps of:

receiving a first audio signal;

generating a digital representation of the first audio signal by applying a head-related transfer function in a first sound reproduction position;

automatically changing the first sound reproduction position to a second sound reproduction position in response to receiving a precursor signal for a second audio signal; and automatically changing the second sound reproduction position to the first sound reproduction position for the first audio signal in response to no longer receiving the second audio signal.

2. The method according to claim 1, wherein the second audio signal is a paging signal or a speech signal.

3. The method according to claim 1, further comprising changing the first sound reproduction position to the second sound reproduction position in response to receiving the precursor signal for the second audio signal and wherein the precursor signal for the second audio signal is a message for establishing a telephone call.

4. The method according to claim 1, further comprising defining the first sound reproduction position and the second sound reproduction position for the first audio signal.

5. The method according to claim 4, further comprising visualizing the first and second sound reproduction positions.

6. The method according to claim 1, further comprising generating a digital representation of the second audio signal by applying a head-related transfer function in a third sound reproduction position, wherein the third sound reproduction position is closer to the middle of the head of the user than the second sound reproduction position.

7. A non-transitory computer readable storage medium containing a set of instructions that when executed enable a processor to:

process a first audio signal;

generate a digital representation of the first audio signal by applying a head-related transfer function in a first sound reproduction position;

automatically change the first sound reproduction position to a second sound reproduction position in response to receiving a precursor signal for a second audio signal; and automatically change the second sound reproduction position to the first sound reproduction position for the first audio signal in response to no longer receiving the second audio signal.

8. The non-transitory computer readable storage medium according to claim 7, wherein the second audio signal is a paging signal or a speech signal received from a communication network.

9. The non-transitory computer readable storage medium according to claim 7, further enabling the processor to change the first sound reproduction position to the second sound reproduction position in response to receiving the precursor signal for the second audio signal, wherein the precursor signal for the second audio signal is a message for establishing a telephone call at the electronic device.

10. The non-transitory computer readable storage medium according to claim 7, further enabling the processor to define the first sound reproduction position and the second sound reproduction position for the first signal.

11. The non-transitory computer readable storage medium according to claim 10, further enabling the processor to provide a visualization of the sound reproduction positions.

12. The non-transitory computer readable storage medium according to claim 7, further enabling the processor to generate a digital representation of the second audio signal by applying a head-related transfer function in a third sound reproduction position, wherein the third sound reproduction position is closer to the middle of the head of the user than the second sound reproduction position.

* * * * *

UNITED STATES PATENT AND TRADEMARK OFFICE

CERTIFICATE OF CORRECTION

PATENT NO. : 8,488,820 B2
APPLICATION NO. : 11/747072
DATED : July 16, 2013
INVENTOR(S) : Jens Erik Pedersen It is certified that error appears in the above-identified patent and that said Letters Patent is hereby corrected as shown below:

On the title page, item (57), Abstract, in column 2, lines 1-8,
delete "A method comprises the steps of: receiving a first audio signal ($S_1$); generating a digital representation ($S_1$") of the first audio signal ($S_1$) by applying a head-related transfer function (HRTF) in a first sound reproduction position ($r_1$); and changing the first sound reproduction position ($r_1$) to a second sound reproduction position ($r_3$) in response to receiving a second audio signal $S_2$) or a precursor signal for a second audio signal ($S_2$)." and
insert -- A first audio signal ($S_1$) is received, where a digital representation ($S_1$') of the first audio signal ($S_1$) is generated by applying a head-related transfer function (HRTF) in a first sound reproduction position ($r_1$). The first sound reproduction position ($r_1$) is changed to a second sound reproduction position ($r_3$) in response to receiving a second audio signal ($S_2$) or a precursor signal for a second audio signal ($S_2$). --, therefor.

Signed and Sealed this
Twelfth Day of November, 2013

Teresa Stanek Rea

Teresa Stanek Rea
*Deputy Director of the United States Patent and Trademark Office*